US006262568B1

(12) United States Patent
Komatsu et al.

(10) Patent No.: US 6,262,568 B1
(45) Date of Patent: Jul. 17, 2001

(54) COMMON MODE BIAS GENERATOR

(75) Inventors: Yoshihide Komatsu; Hironori Akamatsu; Takashi Hirata; Satoshi Takahashi; Yutaka Terada, all of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/734,191

(22) Filed: Dec. 12, 2000

(30) Foreign Application Priority Data

Dec. 14, 1999 (JP) ..... 11-354537

(51) Int. Cl.[7] ..... G05F 3/04
(52) U.S. Cl. ..... 323/312
(58) Field of Search ..... 323/311, 312, 323/314, 316, 317, 349

(56) References Cited

U.S. PATENT DOCUMENTS 4,698,718 * 10/1987 Chow et al. ..... 361/77
5,177,431 * 1/1993 Smith et al. ..... 323/349
5,302,917 * 4/1994 Concorso ..... 330/264
5,686,823 * 11/1997 Rapp ..... 323/313
5,757,173 * 5/1998 Agiman ..... 323/282
5,861,738 * 1/1999 Becker-Irvin et al. ..... 323/282
5,945,814 8/1999 Covaro .

* cited by examiner

*Primary Examiner*—Adolf Deneke Berhane
(74) *Attorney, Agent, or Firm*—McDermott, Will & Emery

(57) ABSTRACT

An inventive potential generator generates a predetermined potential and includes first operational amplifier, current supply circuit and current sink circuit. A first reference potential is applied to the non-inverting input terminal of the first amplifier and a potential at the output node of the first amplifier is not only applied to the inverting input terminal of the first amplifier but also used as the output of the generator. The current supply circuit supplies a current to the output node of the first amplifier if the potential at the output node of the first amplifier is lower than a predefined level. And the current sink circuit drains a current from the output node of the first amplifier if the potential at the output node of the first amplifier is higher than the predefined level.

13 Claims, 9 Drawing Sheets

COMMON MODE BIAS GENERATOR

BACKGROUND OF THE INVENTION

The present invention generally relates to a circuit for generating a potential, and more particularly relates to a common mode bias generator that can supply a required minimum amount of current without dissipating it unnecessarily.

As LSIs have been further miniaturized over the past few years, it has become more and more necessary for analog circuits for the LSIs to operate with even lower power dissipated or to further reduce their sizes. This is because the final value of an LSI product greatly depends on the performance of the analog circuits. Accordingly, the more stringent the requirements imposed on those analog circuits, the more pressing the need for reduction in power dissipation of the circuits. For example, particularly when high-speed transmission should be realized or a wide range of terminal potentials should be handled as in IEEE 1394-compliant systems, analog circuits such as drivers, operational amplifiers and comparators must operate to the limit of their abilities under the current circumstances.

More specifically, if an operational amplifier should supply a large current, then the size of output transistors on the last stage of the amplifier usually has to be increased. This is because if the size of the output transistors is not large enough, then the amplifier cannot supply current in the required amount and eventually the potential at the output node thereof adversely decreases. Thus, that is an inevitable choice to make even though the overall size of the amplifier needs to be reduced.

For example, suppose a TPBIAS circuit should provide an output potential at a certain level and supply a current of about−3 mA to about+25 mA. The circuit, complying with the IEEE 1394, generates a common mode bias voltage at a high-speed differential output node coupled to a so-called "twisted pair" cable. In that case, the sizes of transistors on the last stage of the circuit (e.g., PMOS transistors, in particular) should be increased to such an extent that the circuit can supply the maximum current of 25 mA.

However, as for a common mode bias generator such as that defined by the IEEE 1394, the amount of current to be supplied by the circuit changes incessantly. In other words, the circuit does not always have to supply the maximum amount of current. Accordingly, if the circuit has been designed to always supply the maximum amount of current, then the circuit will waste too much current in vain even while the circuit has to supply no currents (i.e., the amount of current to be supplied is 0 mA). This is because the last-stage transistors of the relatively large size also spend too much current even in such an idling state.

SUMMARY OF THE INVENTION

It is therefore an object of the present invention to provide a potential generator that can always supply a required minimum amount of current without wasting it.

An inventive potential generator is so constructed as to generate a predetermined potential. The generator includes first operational amplifier, current supply circuit and current sink circuit. The first operational amplifier has a non-inverting input terminal, an inverting input terminal and an output node. A first reference potential is applied to the non-inverting input terminal of the first amplifier and a potential at the output node of the first amplifier is not only applied to the inverting input terminal of the first amplifier but also used as the output of the generator. If the potential at the output node of the first amplifier is lower than a predefined level, the current supply circuit supplies a current to the output node of the first amplifier. And if the potential at the output node of the first amplifier is higher than the predefined level, the current sink circuit drains a current from the output node of the first amplifier.

In the inventive generator, the first reference potential will be the potential at the output node of the first amplifier and will eventually be used as the output of the generator. Normally, only the first amplifier is used in the generator. However, if a current has been drained from the generator, then the amount of current to be output by the generator might exceed the maximum amount of current that the first amplifier can supply. Then, the potential at the output node of the first amplifier falls. And when the potential at the output node of the first amplifier gets lower than the predefined level, the current supply circuit supplies a current to the output node of the first amplifier. In this manner, if the amount of current to be output has increased, then the deficit is covered. On the other hand, if a current has been externally supplied to the generator, then the amount of current supplied to the generator might exceed the maximum amount of current that the first amplifier can drain. Then, the potential at the output node of the first amplifier rises. And when the potential at the output node of the first amplifier exceeds the predefined level, the current sink circuit drains a current from the output node of the first amplifier. In this manner, if the amount of current externally supplied to the generator has increased, then the surplus is cut down.

As can be seen, since the inventive generator includes the current supply and sink circuits, the size of transistors on the last stage of the first amplifier does not have to be increased according to the maximum amount of current to be supplied. Thus, the generator can be designed with the size of the transistors on the last stage of the first amplifier reduced so that the amount of current needed to operate the generator may be minimized during its normal operation. As a result, the current dissipated by the generator can be cut down.

In one embodiment of the present invention, the current supply circuit preferably includes second operational amplifier and first transistor, while the current sink circuit preferably includes third operational amplifier and second transistor. The second amplifier has a non-inverting input terminal, an inverting input terminal and an output node. The potential at the output node of the first amplifier is preferably applied to one of the non-inverting and inverting input terminals of the second amplifier. On the other hand, a second reference potential is preferably applied to the other input terminal of the second amplifier. The first transistor is preferably connected between a power supply node, which receives a supply voltage, and the output node of the first amplifier and preferably turns ON or OFF responsive to the output of the second amplifier. The third amplifier also has a non-inverting input terminal, an inverting input terminal and an output node. The potential at the output node of the first amplifier is preferably applied to one of the non-inverting and inverting input terminals of the third amplifier. On the other hand, a third reference potential is preferably applied to the other input terminal of the third amplifier. The second transistor is preferably connected between the output node of the first amplifier and a ground node and preferably turns ON or OFF responsive to the output of the third amplifier.

In the generator with this configuration, when the potential at the output node of the first amplifier gets lower than the second reference potential, the second amplifier provides an activating signal to the first transistor, thereby turning the first transistor ON. As a result, a current is supplied from the power supply node to the output node of the first amplifier, and the current to be output can have its deficit covered. On the other hand, when the potential at the output node of the first amplifier gets higher than the third reference potential, the third amplifier provides an activating signal to the second transistor, thereby turning the second transistor ON. As a result, a current is drained from the output node of the first amplifier to the ground node, and the current externally supplied to the generator can have its surplus cut down.

In this particular embodiment, the second reference potential is preferably lower than the first reference potential, while the third reference potential is preferably higher than the first reference potential.

In such an embodiment, the generator can exhibit hysteresis by applying mutually different reference potentials to the second and third amplifiers. In this manner, it is possible to prevent the second and third amplifiers from generating the activating signals at a time. Thus, the generator can have its current deficit or surplus compensated for non-wastefully.

In an alternative embodiment, the second amplifier may have a negative offset, while the third amplifier may have a positive offset.

In this embodiment, the generator also shows hysteresis by providing respective offsets for the second and third amplifiers. In this manner, it is possible to prevent the second and third amplifiers from generating the activating signals at a time. Thus, the generator can have its current deficit or surplus compensated for non-wastefully.

In still another embodiment, the generator may further include a current source for draining a current from the output node of the first amplifier if the potential at the output node of the first amplifier needs to be decreased to zero volts while the generator is being driven.

In yet another embodiment, the generator may further include a controller for setting the third reference potential to zero volts if the potential at the output node of the first amplifier needs to be decreased to zero volts while the generator is being driven.

In the generator, the third amplifier, having received the third reference potential of zero volts, provides an activating signal to the second transistor, thereby turning the second transistor ON. As a result, the current is drained from the output node of the first amplifier to the ground node and the potential at the output node of the first amplifier can be decreased to zero volts.

In yet another embodiment, the generator may further include a limiter for setting the potential at the output node of the first amplifier to the predefined level when the generator is powered.

In such an embodiment, the instant the generator is powered, the potential at the output node of the first amplifier is limited to the predefined level. Thus, excessively large current will not flow when the generator is powered. Also, since current is supplied in a limited amount when the generator is powered, switching noise is avoidable, too.

In this particular embodiment, the limiter preferably includes a p-channel MOS transistor, which is diode-connected between a power supply node, receiving a supply voltage, and the output node of the first amplifier.

When the generator is powered, the potential at the output node of the first amplifier is limited to a level that is lower than the supply potential by a voltage drop caused by the p-channel MOS transistor.

In yet another embodiment, the generator may further include a current source for supplying a current in a prescribed amount to the output node of the first amplifier for a certain period of time after the generator has been powered.

The generator includes a current source, and can supply a current to the output node of the first amplifier the instant the generator is powered. In this manner, the generator can have its setup time shortened.

In yet another embodiment, the generator may further include a plurality of resistors that are connected in series together between the output node of the first amplifier and a ground node.

In this embodiment, the generator outputs, as referential potentials, potentials at respective interconnection nodes of the resistors. Each of the referential potentials is obtained by dividing the potential at the output node of the first amplifier by the resistors. Normally, a known potential generator gets multiple referential potentials generated by a power circuit provided separately from the generator. In that case, however, the power circuit is easily affected by power noise, whereas the potential generator is not affected by the noise so easily. Accordingly, it is difficult to keep a parallel relationship between the output potentials of these two circuits. As a result, circuits using the referential potentials will be affected. In contrast, the inventive potential generator is much less likely to be affected by the noise, because the potential at the output node of the first amplifier and the referential potentials are output in parallel to each other.

In this particular embodiment, the generator preferably further includes a plurality of capacitors. Each of the capacitors is preferably connected between a node, at which an associated pair of the resistors is interconnected, and the output node of the first amplifier.

In the generator of this embodiment, where the potential at the output node of the first amplifier fluctuates as being affected by noise, the potentials at the respective interconnection nodes between the resistors may also fluctuate in parallel to the potential at the output node of the first amplifier. Thus, even an analog circuit, which uses both the potential at the output node of the first amplifier and the referential potentials alike, will not operate erroneously.

In an alternative embodiment, the generator may further includes a fourth operational amplifier with a non-inverting input terminal, an inverting input terminal and an output node. The potential at the output node of the first amplifier is applied to the non-inverting input terminal of the fourth amplifier and a potential at the output node of the fourth amplifier is applied to the inverting input terminal of the fourth amplifier. And the resistors are connected in series together between the output node of the fourth amplifier and the ground node.

The potential generator includes the fourth amplifier as a voltage follower, which can supply a current that will flow through the resistors. As a result, the amount of current to be supplied by the first amplifier and current supply and sink circuits can be reduced.

In yet another embodiment, the generator may further include a current source for supplying a constant amount of current to the output node of the first amplifier.

A terminal resistor, through which a constant current should always flow, is sometimes connected to the output of a potential generator. In the inventive potential generator, the current source can always supply the current that should flow through the terminal resistor. As a result, the amount of current to be supplied by the first amplifier and current supply and sink circuits can be reduced.

DESCRIPTION OF THE PREFERRED EMBODIMENTS

Figure 1:
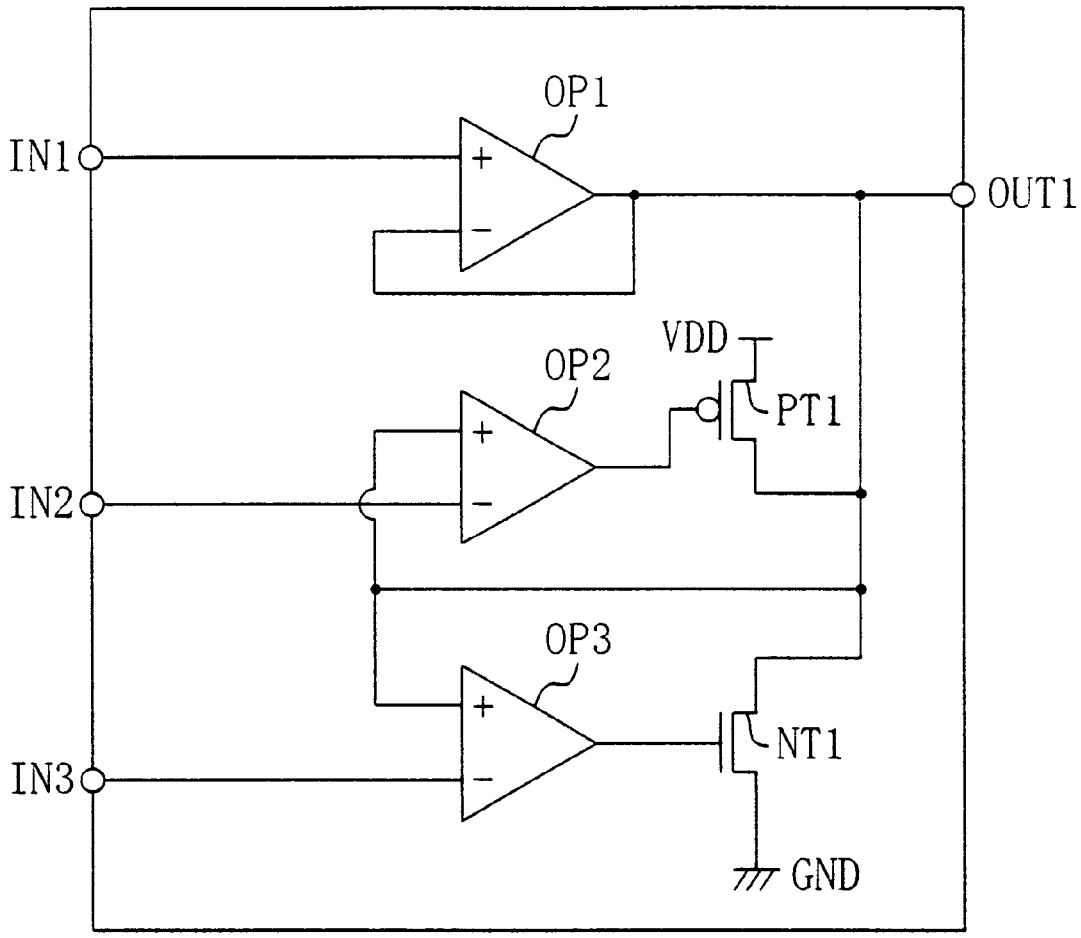
FIGS. 1 through 4 are circuit diagrams illustrating overall configurations for a common mode bias generator according to first, second, third and fourth embodiments of the present invention, respectively.

Hereinafter, preferred embodiments of the present invention will be described with reference to the accompanying drawings. In the drawings, the same or like parts are identified by the same reference numeral to avoid the redundancy of description.

EMBODIMENT 1

FIG. 1 is a circuit diagram illustrating an overall configuration for a common mode bias generator according to a first embodiment of the present invention. As shown in FIG. 1, the generator includes operational amplifiers OP1, OP2 and OP3, p-channel MOS (PMOS) transistor PT1 and n-channel MOS (NMOS) transistor NT1.

The amplifier OP1 has its non-inverting input terminal connected to a terminal IN1, its inverting input terminal connected to its own output terminal, and its output terminal connected to a terminal OUT1. The amplifier OP2 has its non-inverting input terminal connected to the terminal OUT1, its inverting input terminal connected to a terminal IN2, and its output terminal connected to the gate of the PMOS transistor PT1. The amplifier OP3 has its non-inverting input terminal connected to the terminal OUT1, its inverting input terminal connected to a terminal IN3, and its output terminal connected to the gate of the NMOS transistor NT1.

The PMOS transistor PT1 is connected between a power supply node VDD, which receives a supply voltage, and the terminal OUT1, and receives the output of the amplifier OP2 at its gate. The NMOS transistor NT1 is connected between the terminal OUT1 and a ground node GND, and receives the output of the amplifier OP3 at its gate. The size of the PMOS and NMOS transistors PT1 and NT1 is greater than that of any transistor included in the amplifiers OP1 through OP3.

Hereinafter, it will be described how the generator with such a configuration operates.

In the illustrated embodiment, the size of the transistors on the last stage of the amplifier OP1 is defined as small as possible. Accordingly, the current supply ability of the amplifier OP1 is very low. The transistors included in the amplifiers OP2 and OP3 are also designed to have small sizes. Reference potentials of 1.86 V, 1.84 V and 1.90 V are applied to the terminals IN1 through IN3, respectively.

In a normal state, the output potential of the amplifier OP1, i.e., the potential at the terminal OUT1, is 1.86 V, which is the output of the generator. And only the amplifier OP1 is used normally. This state is the normal operation state as defined by the IEEE 1394 standard. While only the amplifier OP1 is being driven, the supply current for the generator is very small. Although some supply current flows through the other two amplifiers OP2 and OP3, the amount of the current is also very small because the transistors included in these amplifiers OP2 and OP3 are of small sizes.

If a current has been drained from the generator to an external unit, then the amount of current to be supplied by the generator soon exceeds the maximum current that the amplifier OP1 can supply. Then, the potential at the output node of the amplifier OP1, i.e., the potential at the terminal OUT1, will drop. And when the potential at the terminal OUT1 reaches 1.84 V, the amplifier OP2 provides an L-level signal to the PMOS transistor PT1 to turn the transistor PT1 ON. As a result, a current is supplied from the power supply node VDD to the terminal OUT1. In this manner, the deficit of the current can be covered even if the current to be supplied has increased. In this case, the potential at the terminal OUT1 shifts from 1.86 V to 1.84 V.

If a current has been externally supplied to the generator, then the amount of current supplied to the generator soon exceeds the maximum current that the amplifier OP1 can drain. Then, the potential at the terminal OUT1 rises. When the potential at the terminal OUT1 reaches 1.90 V, the amplifier OP3 provides an H-level signal to the NMOS transistor NT1 to turn the transistor NT1 ON. As a result, a current is drained from the terminal OUT1 to the ground node GND. In this manner, the surplus of the current can be cut down even if the current supplied externally has increased. In this case, the potential at the terminal OUT1 shifts from 1.86 V or 1.84 V to 1.90 V.

As can be seen, if current has been drained from, or externally supplied to, this common mode bias generator, then the amplifier OP2 or OP3 turns the associated transistor PT1 or NT1 ON, thereby compensating for the deficit or surplus of the current supplied by the generator. Accordingly, the size of the transistors in the amplifier OP1 does not have to be determined according to the maximum current but can be as small as possible. In addition, since the transistors PT1 and NT1 are of a relatively large size, the transistors in the amplifiers OP2 and OP3 may be of small sizes. As a result, the current dissipated by the generator can be cut down.

The generator can exhibit hysteresis by applying mutually different potentials to the terminals IN1 through IN3. In this manner, it is possible to prevent the amplifiers OP2 and OP3 from operating concurrently. Thus, the generator can have its current deficit or surplus compensated for non-wastefully. Furthermore, unwanted oscillation involved with operational amplifiers is also avoidable.

Optionally, the generator can also show hysteresis by providing respective offsets to the amplifiers OP2 and OP3. Specifically, the operating potential of the amplifier OP2 may have a negative offset relative to the amplifier OP1, while the operating potential of the amplifier OP3 may have a positive offset relative to the amplifier OP1. The same effects as those described above are also attainable even by doing so.

It should be noted that the amplifier OP2 may have its non-inverting and inverting input terminals interchanged with each other, i.e., an NMOS transistor may be provided in place of the PMOS transistor PT1. Alternatively, the amplifier OP3 may also have its non-inverting and inverting input terminals interchanged with each other, i.e., a PMOS transistor may be provided in place of the NMOS transistor NT1.

EMBODIMENT 2

Figure 2:
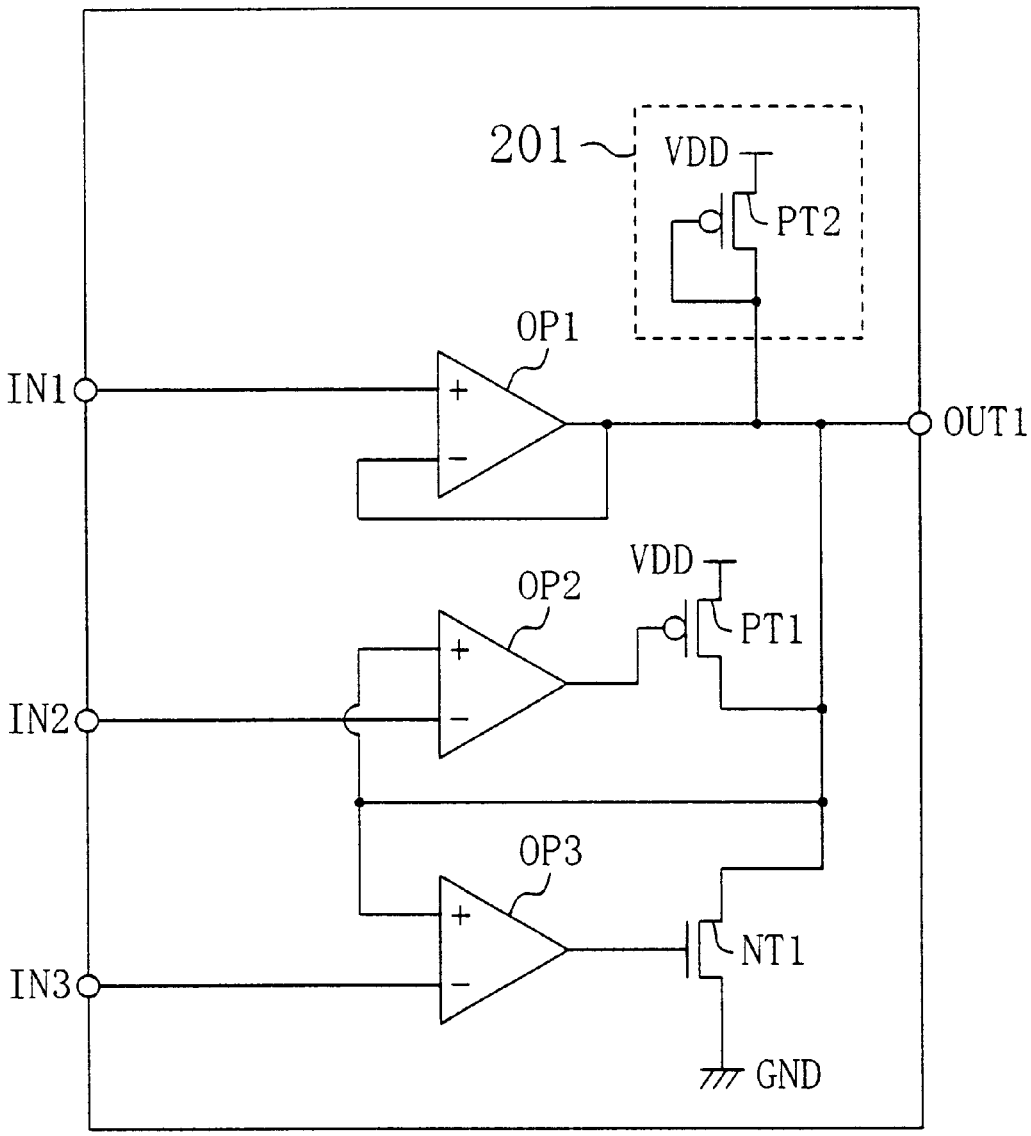

FIG. 2 is a circuit diagram illustrating an overall configuration for a common mode bias generator according to a second embodiment of the present invention. The generator shown in FIG. 2 further includes a limiter 201 in addition to all the components of the generator shown in FIG. 1. The limiter 201 includes a PMOS transistor PT2, which is diode-connected between the power supply node VDD and the terminal OUT1.

The instant this generator is powered, the potential at the terminal OUT1 is set to a level lower than the supply potential by a voltage drop caused by the PMOS transistor PT2. In this manner, it is possible to prevent a large current from flowing out when the generator is powered. In addition, since a limited amount of current is supplied when the generator is powered, switching noise is also avoidable.

In the illustrated embodiment, just one PMOS transistor PT2 is provided for the limiter 201. Alternatively, multiple diode-connected PMOS transistors may be provided in series between the power supply node VDD and the terminal OUT1.

EMBODIMENT 3

Figure 3:
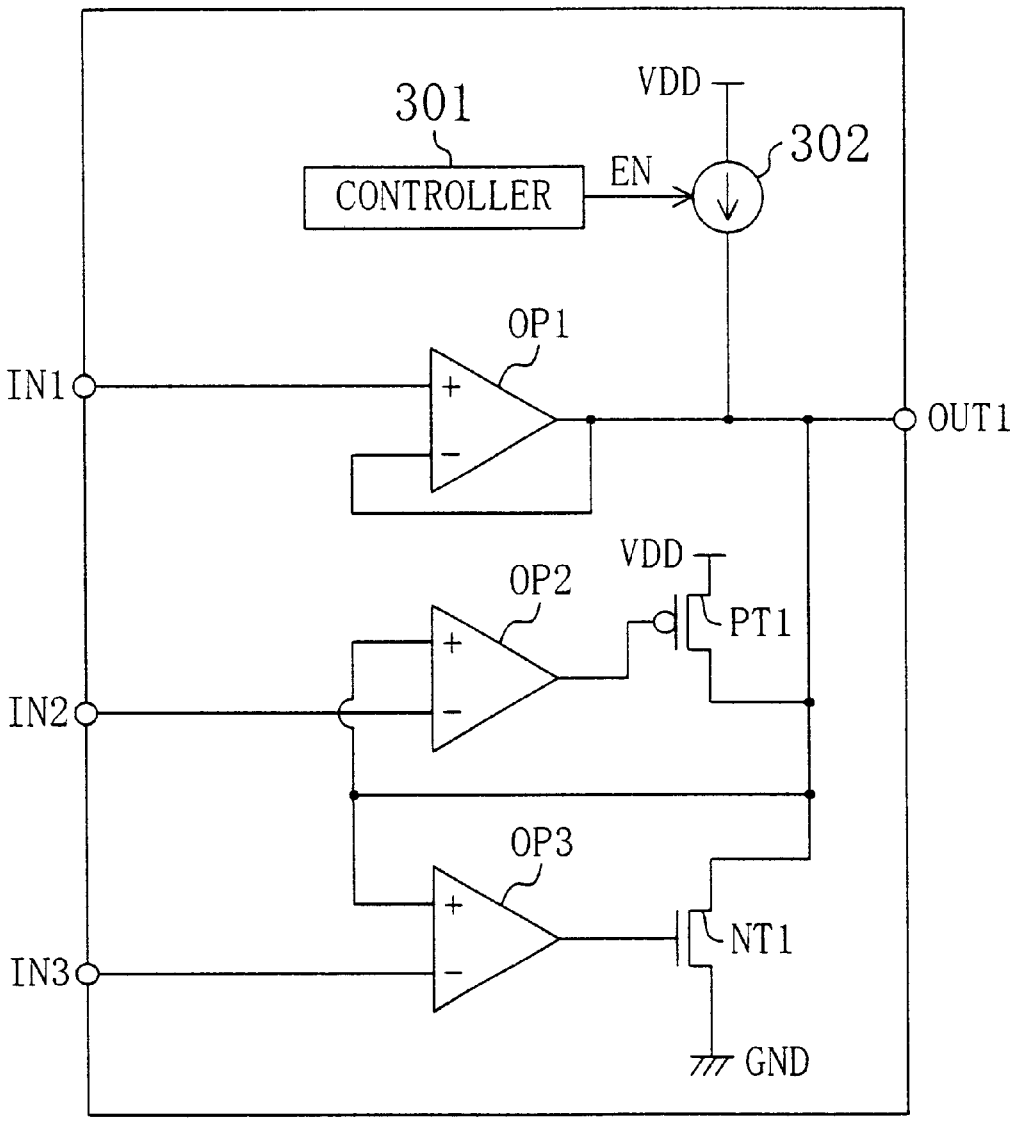

FIG. 3 is a circuit diagram illustrating an overall configuration for a common mode bias generator according to a third embodiment of the present invention. The generator shown in FIG. 3 further includes a controller 301 and a current source 302 in addition to all the components of the generator shown in FIG. 1. The controller 301 asserts an enable signal EN and provides the signal to the current source 302 for a predetermined period of time after the generator has been powered. In response to the enable signal EN, the current source 302 supplies the maximum amount of current that the generator can generate to the terminal OUT1.

The generator of this embodiment can supply a current to the terminal OUT1 instantaneously when the generator is powered. In this manner, the generator can have its setup time shortened.

EMBODIMENT 4

Figure 4:
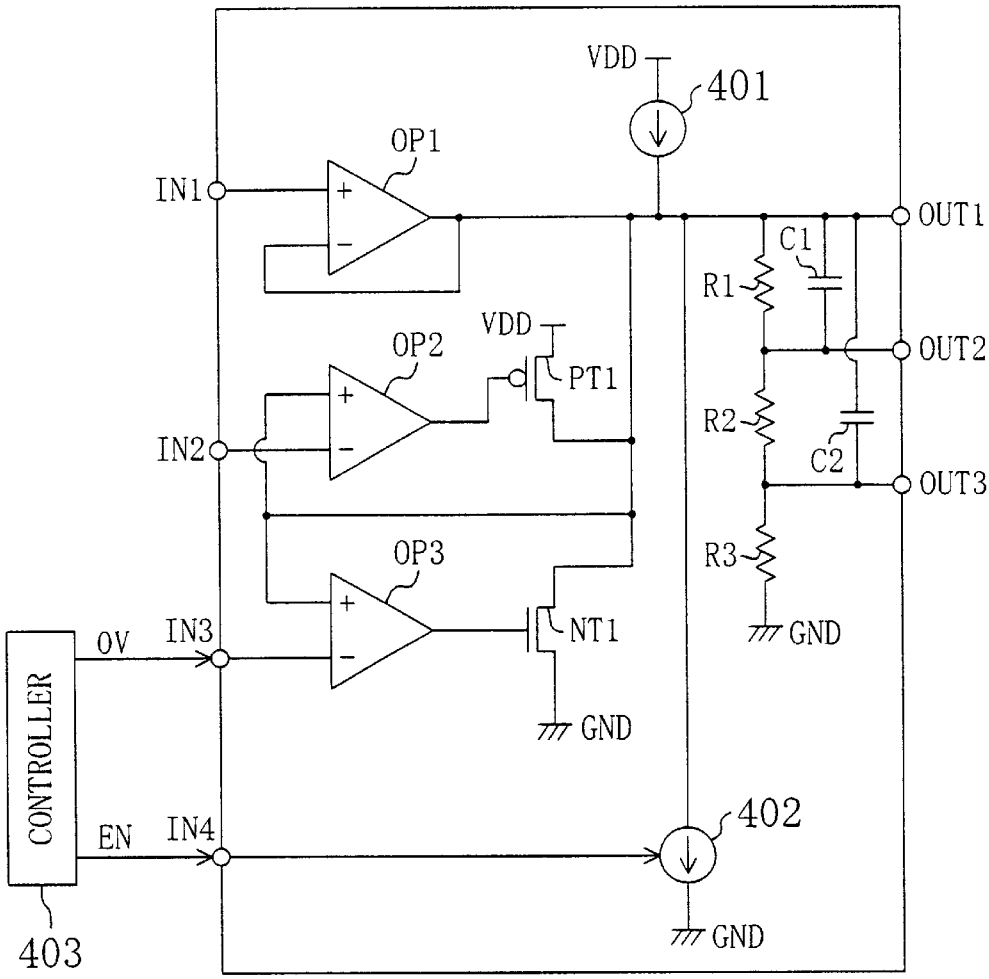

FIG. 4 is a circuit diagram illustrating an overall configuration for a common mode bias generator according to a fourth embodiment of the present invention. The generator shown in FIG. 4 further includes current sources 401 and 402, controller 403, resistors R1, R2 and R3 and capacitors C1 and C2 in addition to all the components of the generator shown in FIG. 1.

The current source 401 is provided between the power supply node VDD and the terminal OUT1 to supply a constant current to the terminal OUT1.

If the potential at the terminal OUT1 should be decreased to zero volts while the generator is being driven, the controller 403 applies a potential of 0 V to the terminal IN3 and provides an asserted enable signal EN to the terminal IN4. The current source 402 is provided between the terminal OUT1 and the ground node GND. In response to the enable signal EN provided through the terminal IN4, the current source 402 drains a current from the terminal OUT1 to the ground node GND.

The resistors R1, R2 and R3 are connected in series together between the terminal OUT1 and the ground node GND. An interconnection node of the resistors R1 and R2 is connected to the terminal OUT2, while an interconnection node of the resistors R2 and R3 is connected to the terminal OUT3. The capacitor C1 is connected between the terminals OUT1 and OUT2, while the capacitor C2 is connected between the terminals OUT1 and OUT3.

Hereinafter, it will be described how the generator with such a configuration operates.

A terminal resistor sometimes needs to be connected to the terminal OUT1 in an IEEE 1394-compliant system, for example. In that case, the generator has to always supply a very small, constant amount of current through the terminal resistor. In the generator shown in FIG. 4, the current source 401 can always supply the current that should flow through the terminal resistor constantly. As a result, the amount of current to be supplied by the amplifiers OP1 through OP3 can be reduced.

Also, the potential at the terminal OUT1 sometimes needs to be decreased to 0 V while the generator is being driven. In that case, the controller 403 applies a potential of 0 V to the terminal IN3. In response, the amplifier OP3 provides an H-level signal to the gate of the NMOS transistor NT1, thereby turning the transistor NT1 ON. As a result, a current is drained from the terminal OUT1 to the ground node GND. At the same time, the controller 403 also provides an asserted enable signal EN to the current source 402 through the terminal IN4. In response, the current source 402 drains the current from the terminal OUT1 to the ground node GND. In this manner, the potential at the terminal OUT1 can be set equal to 0 V.

In the illustrated embodiment, both the current source 402 and the amplifier OP3 are used. However, the potential at the terminal OUT1 may also be set to 0 V by using either the current source 402 or the amplifier OP3.

Also, multiple referential potentials sometimes need to be generated. Normally, a power circuit generates those multiple referential potentials. In that case, however, the power circuit is easily affected by power noise, whereas the common mode bias generator is not affected by the noise so easily. Accordingly, it is difficult to keep a parallel relationship between the output potentials of these two circuits. As a result, circuits using the referential potentials will be adversely affected.

The generator of the fourth embodiment outputs the potentials at the terminals OUT2 and OUT3, which are obtained by dividing the potential at the terminal OUT1 by the resistors R1 through R3, as referential potentials. In this manner, the generator outputs the potential at the terminal OUT1 and the potentials at the terminals OUT2 and OUT3 in parallel to each other. Accordingly, the generator is much less affected by the noise.

The generator of this embodiment further includes the capacitors C1 and C2. Thus, if the output potential of the amplifier OP1, i.e., the potential at the terminal OUT1, fluctuates as being affected by noise, then the potentials at the terminals OUT2 and OUT3 (i.e., the referential potentials) may also fluctuate in parallel to the output potential of the amplifier OP1. Thus, even an analog circuit, which uses both the output potential of the amplifier OP1 and the referential potentials alike, will not operate erroneously.

Figure 5:
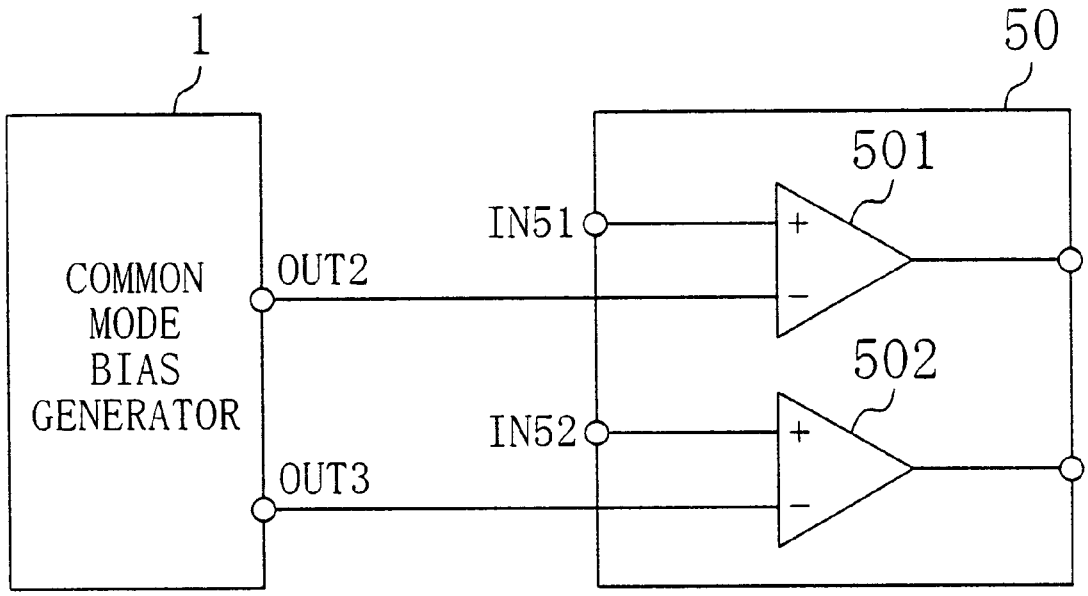
FIG. 5 illustrates a circuit for sensing a speed.

FIG. 5 illustrates an exemplary circuit for sensing a speed for use in an IEEE 1394-compliant high-speed analog circuit, for example. In this speed sensor 50, potentials of a cable, connected to the terminal OUT1 of the generator shown in FIG. 4, are applied to terminals IN51 and IN52, respectively. An operational amplifier 501 senses a difference (i.e., a voltage drop) between the potential at the terminal OUT2 and the potential at the terminal IN51. On the other hand, an operational amplifier 502 senses a difference (i.e., a voltage drop) between the potential at the terminal OUT3 and the potential at the terminal IN52. In this manner, the circuit 50 senses a speed based on the voltage drops from the cable potentials. If the referential potentials for this sensor 50 (i.e., the potentials at the terminals OUT2 and OUT3) are not parallel to the potential at the terminal OUT1 of the generator shown in FIG. 4, then the sensor 50 might operate erroneously. In this case, however, the potential at the terminal OUT1 is output in parallel to the potentials at the terminals OUT2 and OUT3. Accordingly, the sensor 50 will not operate erroneously.

EMBODIMENT 5

Figure 6:
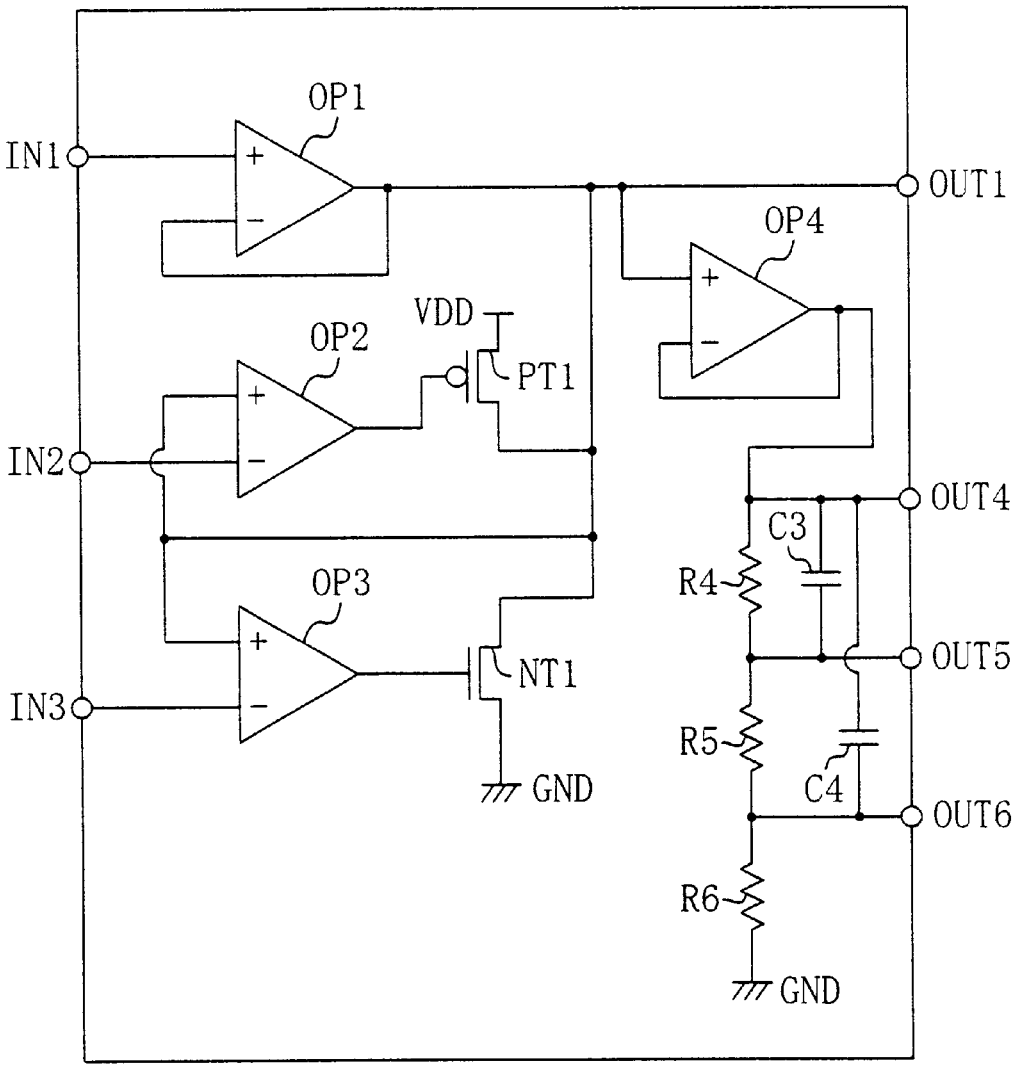
FIG. 6 is a circuit diagram illustrating an overall configuration for a common mode bias generator according to a fifth embodiment of the present invention.

FIG. 6 is a circuit diagram illustrating an overall configuration for a common mode bias generator according to a fifth embodiment of the present invention. The generator shown in FIG. 6 further includes operational amplifier OP4, resistors R4, R5 and R6 and capacitors C3 and C4 in addition to all the components of the generator shown in FIG. 1.

The amplifier OP4 has its non-inverting input terminal connected to the terminal OUT1, its inverting input terminal connected to its own output terminal, and its output terminal connected to a terminal OUT4. The resistors R4, R5 and R6 are connected in series together between the terminal OUT4 and the ground node GND. An interconnection node of the resistors R4 and R5 is connected to a terminal OUT5, while an interconnection node of the resistors R5 and R6 is connected to a terminal OUT6. The capacitor C3 is connected between the terminals OUT4 and OUT5, while the capacitor C4 is connected between the terminals OUT4 and OUT6.

The resistors R4 through R6 and the capacitors C3 and C4 performs the same function as, and attain the same effects as, the resistors R1 through R3 and the capacitors C1 and C2 shown in FIG. 4.

In this generator, the fourth amplifier supplies the current that should flow through the resistors R4 through R6. Thus, the current to be supplied by the amplifiers OP1 through OP3 can be reduced.

Simulations

Figure 7:
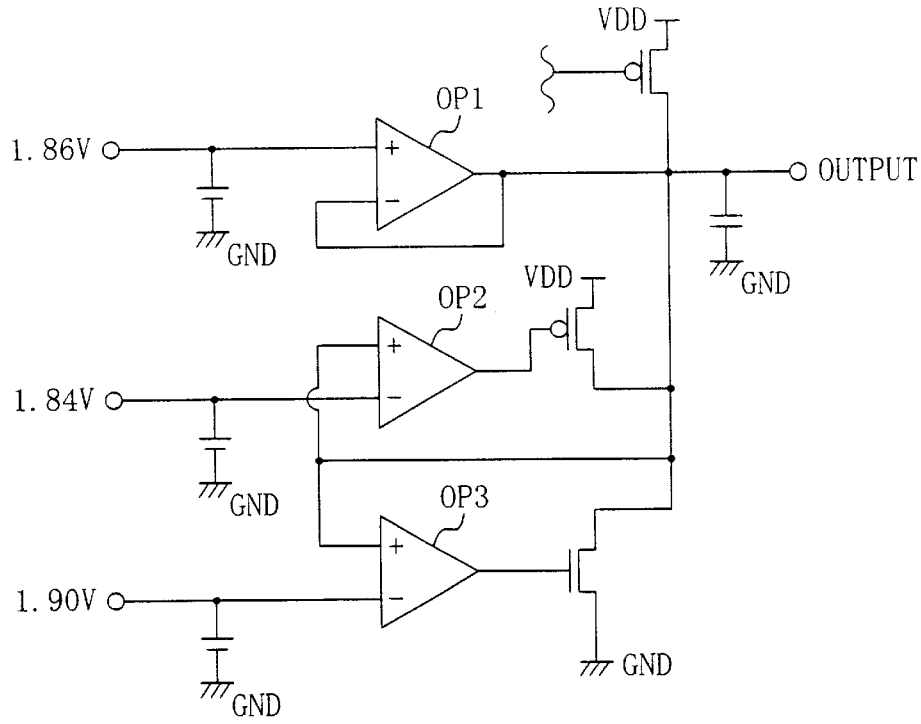
FIG. 7 is a circuit diagram illustrating a configuration for a circuit subjected to simulations.

We carried out transient, DC and AC (including phase compensation) simulations on the common mode bias generator shown in FIG. 7.

Hereinafter, a relation between the output potential and the current supplied as observed during the transient simulation will be described with reference to FIG. 8.

Figure 8:
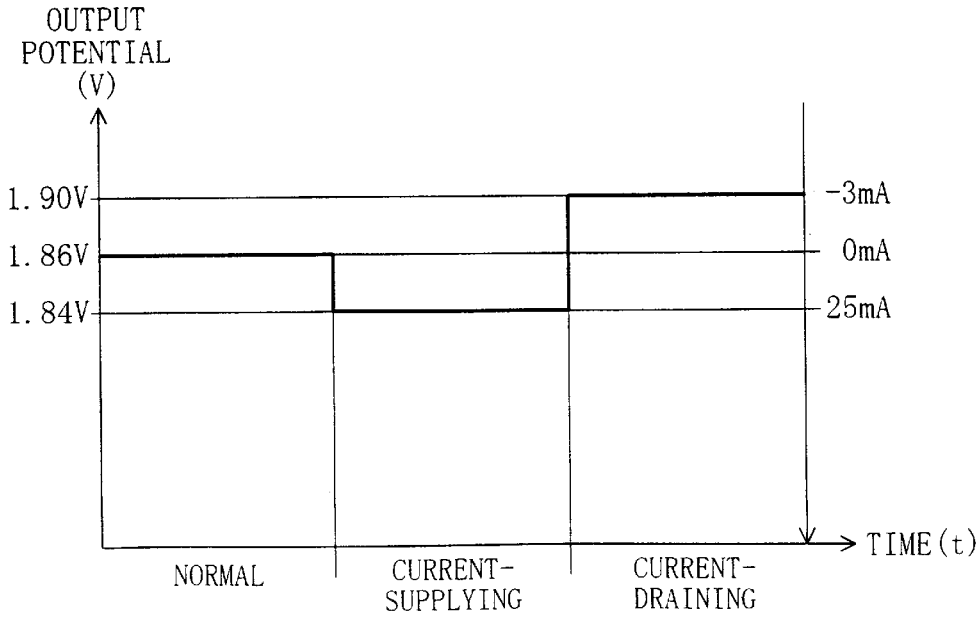
FIG. 8 is a graph illustrating a relation between the output potential and the current supplied in a transient simulation.

While the operational amplifier OP1 (i.e., the amplifier used normally) was operating, the generator outputted a potential of about 1.86 V but supplied almost no current (i.e., in the normal state shown in FIG. 8). After the generator started to supply a current of about 25 mA, the output potential decreased to about 1.84 V (i.e., in the current-supplying state shown in FIG. 8), because the operational amplifier OP2 was operating. And when a current of 3 mA was drained, the output potential increased to about 1.90 V (i.e., in the current-draining state shown in FIG. 8). This indicates that the operational amplifier OP3 started to operate.

Figures 9A, 9B, 9C:
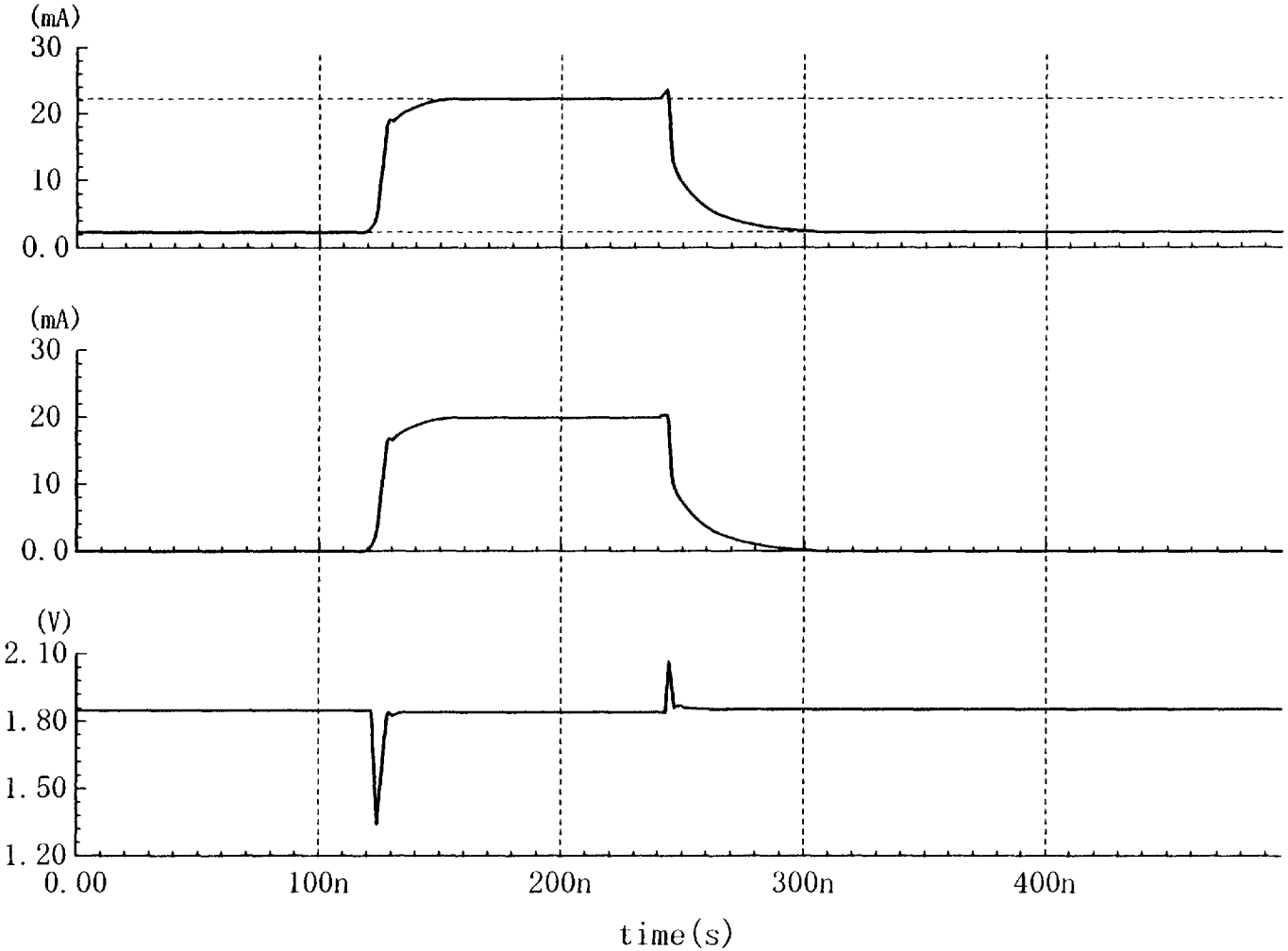
FIGS. 9A through 9C are graphs illustrating results of simulations on the operating current, output current and output voltage of a common mode bias generator, respectively.

FIGS. 9A through 9C are graphs illustrating results of simulations actually performed on the operating current, output current and output voltage of a common mode bias generator, respectively.

In the period between 0 ns and 120 ns, the output potential was 1.86 v as shown in FIG. 9C. In the meantime, a current of 0 mA was output and the operating current was as low as about 2 mA as shown in FIG. 9B and 9A, respectively.

In the period between 120 ns and 240 ns, the generator outputted a current of about 20 mA as shown in FIG. 9B. In the meantime, the operating current was about 22 mA as shown in FIG. 9A. Also, as can be seen from FIG. 9C, the output potential shifted from 1.86 V to about 1.84 V because the operational amplifier OP2 shown in FIG. 7 was operating while the current was being output.

As also can be seen, the original state was restored from 240 ns on because the supply of current was stopped at that time.

Figures 10A, 10B:
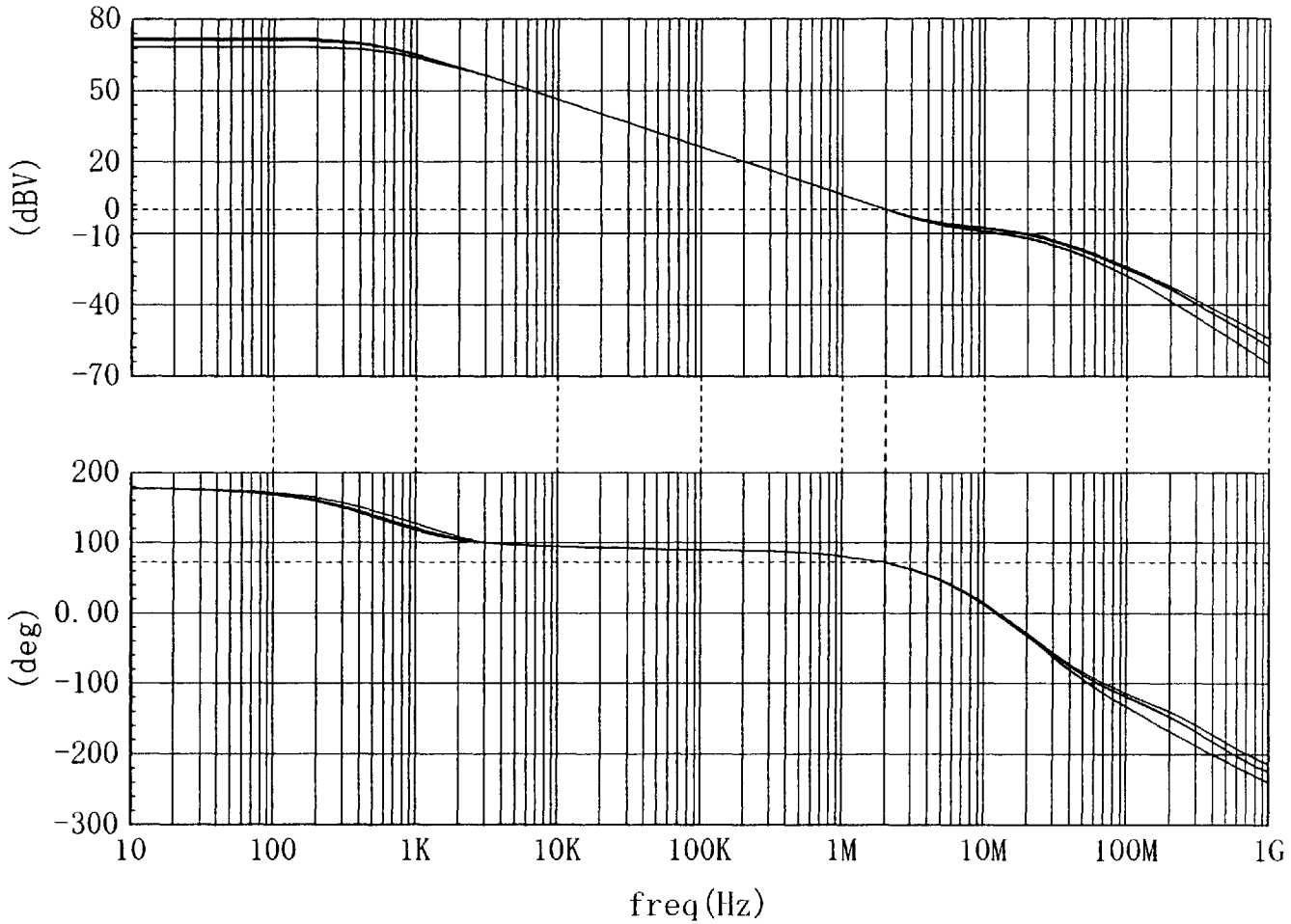
FIGS. 10A and 10B are graphs illustrating results of phase compensation simulations.

FIGS. 10A and 10B are graphs illustrating results of the phase compensation simulations, where VDD was set to 3.6 V, 2.9 v and 2.2 V.

Normally, where the arrangement of operational amplifiers such as that shown in FIG. 7 is adopted, the phase compensation is not always realized because there are three stages of feedback loops in the generator. In the circuit shown in FIG. 7, however, mutually different potentials are applied to the respective input terminals of the operational amplifiers OP1 through OP3 so that the circuit shows hysteresis and that the amplifiers OP2 and OP3 will not operate concurrently. Accordingly, no oscillation will be caused in the circuit and the phase compensation is realized.

As can be seen from the results shown in FIGS. 10A and 10B, a phase compensation of about 70 degrees is attainable.

What is claimed is:

1. A potential generator for generating a predetermined potential, the generator comprising:

a first operational amplifier with a non-inverting input terminal, an inverting input terminal and an output node, where a first reference potential is applied to the non-inverting input terminal of the first amplifier and a potential at the output node of the first amplifier is not only applied to the inverting input terminal of the first amplifier but also used as the output of the generator;

a current supply circuit for supplying a current to the output node of the first amplifier if the potential at the output node of the first amplifier is lower than a predefined level; and a current sink circuit for draining a current from the output node of the first amplifier if the potential at the output node of the first amplifier is higher than the predefined level.

2. The generator of claim 1, wherein the current supply circuit comprises:

a second operational amplifier with a non-inverting input terminal, an inverting input terminal and an output node, where the potential at the output node of the first amplifier is applied to one of the non-inverting and inverting input terminals of the second amplifier, while a second reference potential is applied to the other input terminal of the second amplifier; and a first transistor, which is connected between a power supply node and the output node of the first amplifier and which turns ON or OFF responsive to the output of the second amplifier, the power supply node receiving a supply voltage, and wherein the current sink circuit comprises:

a third operational amplifier with a non-inverting input terminal, an inverting input terminal and an output node, where the potential at the output node of the first amplifier is applied to one of the non-inverting and inverting input terminals of the third amplifier, while a third reference potential is applied to the other input terminal of the third amplifier; and a second transistor, which is connected between the output node of the first amplifier and a ground node and which turns ON or OFF responsive to the output of the third amplifier.

3. The generator of claim 2, wherein the second reference potential is lower than the first reference potential, and wherein the third reference potential is higher than the first reference potential.

4. The generator of claim 2, wherein the second amplifier has a negative offset, and wherein the third amplifier has a positive offset.

5. The generator of claim 1, further comprising a current source for draining a current from the output node of the first amplifier if the potential at the output node of the first amplifier needs to be decreased to zero volts while the generator is being driven.

6. The generator of claim 2, further comprising a controller for setting the third reference potential to zero volts if the potential at the output node of the first amplifier needs to be decreased to zero volts while the generator is being driven.

7. The generator of claim 1, further comprising a limiter for setting the potential at the output node of the first amplifier to the predefined level when the generator is powered.

8. The generator of claim 7, wherein the limiter comprises a p-channel MOS transistor, which is diode-connected between a power supply node and the output node of the first amplifier, the power supply node receiving a supply voltage.

9. The generator of claim 1, further comprising a current source for supplying a current in a prescribed amount to the output node of the first amplifier for a certain period of time after the generator has been powered.

10. The generator of claim 1, further comprising a plurality of resistors that are connected in series together between the output node of the first amplifier and a ground node.

11. The generator of claim 10, further comprising a plurality of capacitors, each said capacitor being connected between a node, at which an associated pair of the resistors is interconnected, and the output node of the first amplifier.

12. The generator of claim 10, further comprising a fourth operational amplifier with a non-inverting input terminal, an inverting input terminal and an output node, where the potential at the output node of the first amplifier is applied to the non-inverting input terminal of the fourth amplifier and a potential at the output node of the fourth amplifier is applied to the inverting input terminal of the fourth amplifier, and wherein the resistors are connected in series together between the output node of the fourth amplifier and the ground node.

13. The generator of claim 1, further comprising a current source for supplying a constant amount of current to the output node of the first amplifier.

* * * * *